United States Patent [19]

Kerby

[11] 4,341,323

[45] Jul. 27, 1982

[54] SEAL FOR FLOATING ROOF TANKS

[75] Inventor: Jacques C. Kerby, Torrance, Calif.

[73] Assignee: Mobil Oil Corporation, New York, N.Y.

[21] Appl. No.: 242,215

[22] Filed: Mar. 10, 1981

[51] Int. Cl.[3] ..... B65D 88/46

[52] U.S. Cl. ..... 220/224

[58] Field of Search ..... 220/216–227

[56] References Cited

U.S. PATENT DOCUMENTS

| | | | |
|---|---|---|---|
| 1,865,792 | 8/1928 | Santos . | |
| 2,134,167 | 10/1938 | Wise | 220/217 X |
| 2,180,587 | 12/1937 | Hammeren . | |
| 2,190,476 | 1/1937 | Haupt et al. . | |
| 2,318,135 | 5/1943 | Wiggins | 220/224 |
| 2,329,966 | 5/1940 | Wiggins . | |
| 2,459,178 | 10/1945 | Moyer . | |
| 2,531,424 | 11/1950 | Goldsby et al. | 220/225 |
| 2,897,998 | 8/1956 | Ulm . | |
| 4,004,708 | 1/1977 | Boyd | 220/226 X |
| 4,099,643 | 7/1978 | Wardwell et al. . | |

FOREIGN PATENT DOCUMENTS

| | | | |
|---|---|---|---|
| 541061 | 12/1931 | Fed. Rep. of Germany | 220/224 |
| 487774 | 11/1936 | United Kingdom . | |
| 899912 | 6/1982 | United Kingdom | 220/222 |

*Primary Examiner*—Stephen Marcus

*Attorney, Agent, or Firm*—Charles A. Huggett; Michael G. Gilman; Stanislaus Aksman

[57] ABSTRACT

An improved bracket assembly for a floating roof tank comprises a primary seal element and an auxiliary seal element placed above the primary seal element. A spring-tensioned rolling element, such as a wheel, is placed above the auxiliary sealing element in spaced relationship thereto. The rolling element is inclined with respect to the vertical wall of the tank at an angle of 10 to 60 degrees, thereby assuring a continuous and constant contact of the rolling element and of the auxiliary sealing element with the inside wall of the tank and substantially preventing the escape of vapors from the tank.

9 Claims, 4 Drawing Figures

SEAL FOR FLOATING ROOF TANKS

FIELD OF THE INVENTION

This invention relates to floating roof storage tanks for volatile liquid products such as light crude oils, motor and aviation gasoline and jet fuels. More particularly, this invention relates to an improved seal for floating roof storage tanks which substantially reduces or eliminates losses of vapors from the tanks.

BACKGROUND OF THE INVENTION

Tankage capability is an important ingredient of any industrial facility handling large quantities of liquid fuels, e.g., a petroleum refining plant processing hundreds of thousands of barrels of oil a day. To insure continuing uninterrupted operation, the facility must contain means for storing raw materials (e.g., crude petroleum feed) and products manufactured in the facility. One of the oldest storing means used in the petroleum industry are fixed roof tanks usually having conically-shaped roofs. However, it has been found that the fixed roof tanks allow substantial amounts of vaporized materials to escape from the tanks due to the phenomena called "breathing", and to losses occurring during filling and withdrawal of materials from and into the tank. Breathing occurs when constantly changing cycles of temperature force contraction of the gas volume on cooling and consequent inhalation of air into the tank. Conversely, an increase in temperature expands the gas volume, forcing the vapor-saturated air to flow out through the tank vents. After each cycle, the vapor phase of the tank comes into an equilibrium with the liquid stored therein. Upon exhalation, at least some of the light ends of the stored products are withdrawn from the tank. Although some conservation means have been designed for the fixed roof storage tanks, e.g., pressure-vacuum valves in the vents of roof tanks, floating roof tanks have found increased acceptance and popularity in the industry.

A floating roof tank typically comprises a substantially cylindrical tank having a roof floating on the liquid contents of the tank. The most popular roof designs are pontoon and double pontoon roofs. A floating roof tank substantially reduces the losses of vapors from above the liquid level because the vapors can escape only from a small peripheral space between the wall of the tank and the floating roof. However, due to constantly increasing cost of petroleum products and crude, and due to environmental considerations, eliminating or substantially decreasing even the small losses from the peripheral area is becoming an important consideration.

Attempts have been made in prior art to decrease such losses by providing the floating roofs with flexible seals extending from the roof outwardly toward the tank wall. However, it has been found that protrusions on the inside wall of the tank, e.g., rivets, bolts and buttstraps allow the escape of some of the vapors even through such seals. The protrusions also damage the seals, thereby increasing maintenance and capital costs associated with roof tanks having such seals. Accordingly, attempts have been made in prior art to use a double seal construction comprising a primary seal made of a flexible material and extending from the floating roof to the vertical inner wall of the tank, and an auxiliary seal super-imposed above the primary seal and constructed of a plurality of flexible sheet members above the primary seal (e.g., Wadwell et al, U.S. Pat. No. 4,099,643). Thus, the auxiliary seal and the primary seal form a vapor space which decreases the amount of vaporized products able to escape from the tank when the auxiliary seal encounters an obstacle in the inside wall of the tank. However, even this double-seal design has also presented some maintenance problems insofar as the constant contact thereof with the obstacles on the inside wall of the tank may cause damage to the seal, thereby necessitating periodic replacement thereof.

Attempts have also been made in prior art to provide tanks using only a single seal construction with a roller, in some designs fastened to a tensioned support, and placed above the seal (see, e.g., British Patent No. 487,774, Hammeren, U.S. Pat. No. 2,180,587 and Haupt, U.S. Pat. No. 2,190,476). The roller rides on the inside surface of the tank to guide the movement of the floating roof and to ride over projections of the inside wall. However, the prior art designs incorporating the roller exhibit several deficiencies which allow the vapors to escape from above the liquid surface. For example, the rollers, due to their angle of inclination with respect to the wall are not pressed against the wall with sufficient force, nor with uniform pressure, thereby allowing some vapors to escape into the atmosphere. The rollers of the prior art also do not compensate for variations in the diameter of the tank, or for irregularities of the inside of the tank shell, nor do they provide sufficient pressure to keep the entire circumference of the roof in substantially constant contact with the inside tank wall. Additionally, the prior art roof seal designs incorporating the rollers use them in conjunction with a single seal construction, thus allowing relatively large quantities of valuable vapors to escape into the atmosphere. The prior art roof seal designs also do not satisfy increasingly stringent environmental requirements which mandate very low levels of hydrocarbons emissions and a complete separation of primary and secondary seals.

Accordingly, it is a primary object of this invention to provide an improved sealing means for floating roof storage tanks.

An additional object of this invention is to provide a floating roof storage tank with an improved sealing means comprising a roller inclined with respect to the vertical surface of an inner wall of the tank at a specific angle, thereby effectively preventing substantially all of the vapors from escaping into the atmosphere.

It is an additional object of this invention to provide a floating roof storage tank utilizing a double-seal construction with a roller means inclined at a specific angle with respect to the vertical inner wall of the tank, thereby preventing the obstructions in the tank wall, e.g., rivets and buttstraps, from damaging the double-seal of the floating roof tank and compensating for irregularities of the inside wall diameter by providing constant and continuous pressure on the secondary seals.

Additional objects of this invention will become apparent to those skilled in the art from the study of the following specification and appended claims.

SUMMARY OF THE INVENTION

A floating roof storage tank utilizing a double-seal construction comprises a spring-tensioned bracket means supporting the auxiliary or secondary seal. The auxiliary seal is positioned above a conventional primary seal and it is spaced therefrom to define a vapor space. The bracket also supports a rolling means, e.g., a substantially flat roller, spaced above the auxiliary seal, which is constantly in contact with the inside wall of the tank and which is inclined with respect to the wall at a specific angle. The mounting of the roller at an angle with respect to the wall of the tank and spring-tensioning the bracket supporting the roller insures constant contact of the auxiliary seal with the inner wall of the tank. The construction of the roof tank of the present invention with a double-seal construction and having an inclined spring-tensioned roller substantially completely seals the vapors in the vapor space between the two seals, thereby resulting in considerable savings and in compliance of the tank with environmental regulations.

DETAILED DESCRIPTION OF THE INVENTION

Figure 1:
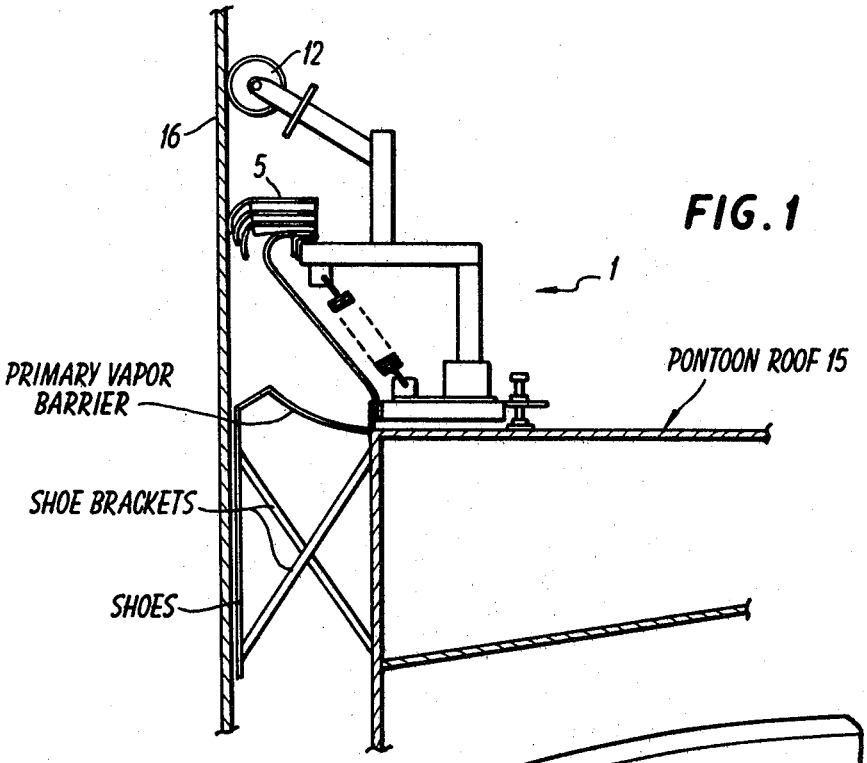
FIG. 1 is a cross-section of a floating roof equipped with a conventional primary seal and with the novel bracket of this invention supporting a secondary seal.

As illustrated in FIG. 1, the novel bracket 1 is placed on top of a pontoon comprising a floating roof in a floating roof tank. The roof is equipped with a conventional primary vapor barrier or seal having stainless steel shoes which press the primary seal into contact with the inner surface of the tank wall. The primary vapor seal and the shoes used herein can be of any conventional design, and it is believed their operation will be obvious to those skilled in the art. Constructional details of the bracket 1 and of the secondary seal are illustrated in FIGS. 3 and 4, and described below.

Figure 2:
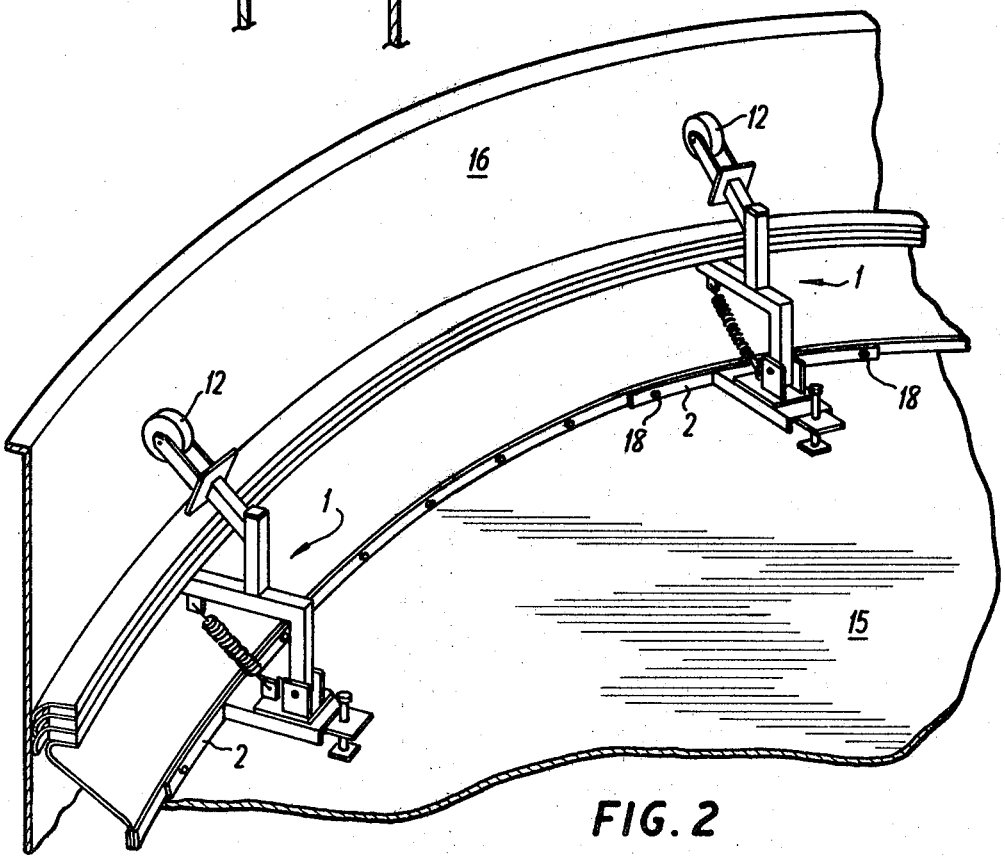
FIG. 2 is a perspective view of a floating roof tank equipped with a number of the novel brackets of this invention.
Figure 3:
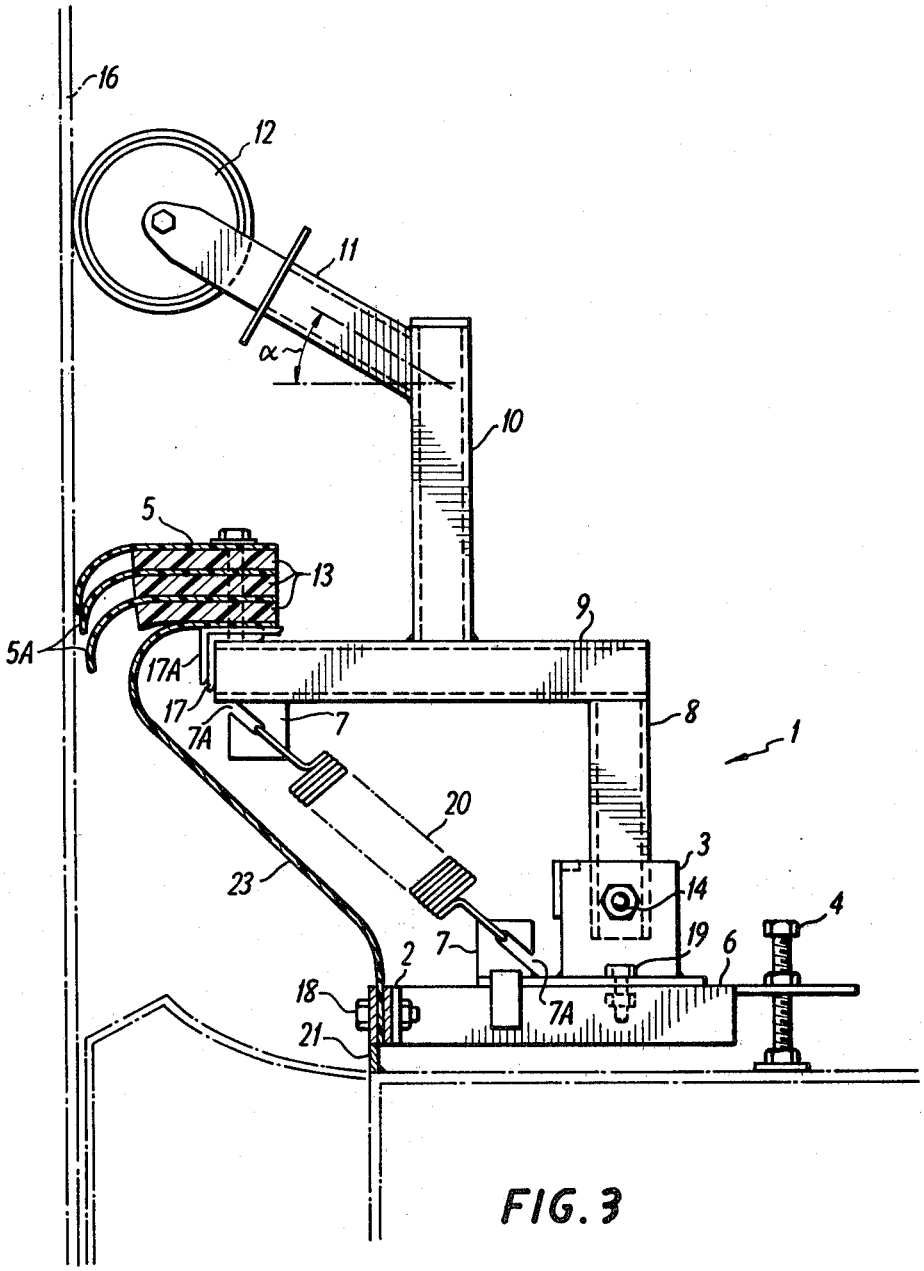
FIG. 3 is a side view of the bracket of the present invention.
Figure 4:
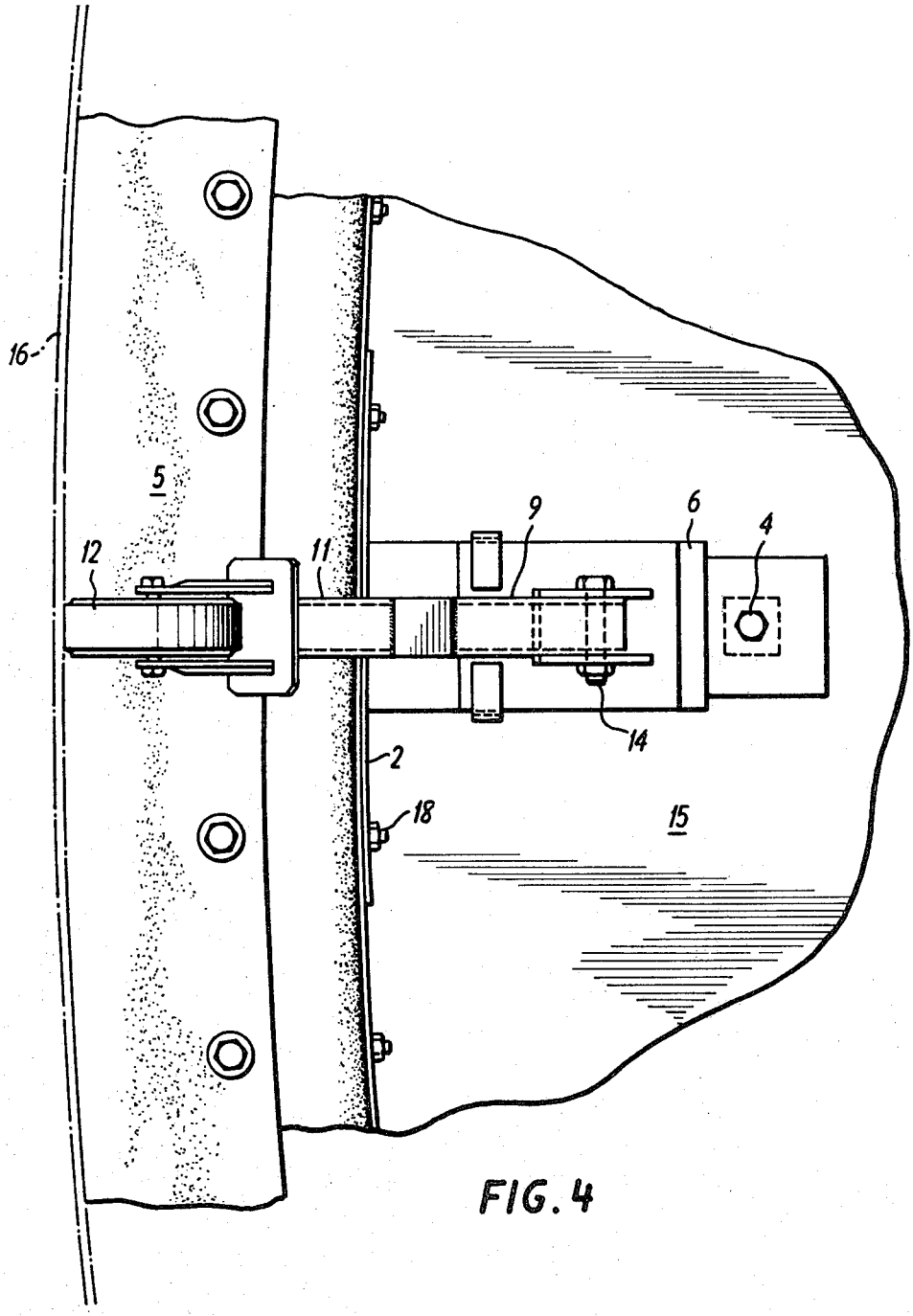
FIG. 4 is a top view of the bracket of the present invention.

The bracket 1 comprises a first arm 6 parallel to and attached to a flexible skirt 23 by a fastening means, such as a metal strip 2 shown in FIGS. 2 and 3. The arm 6 is supported on the roof 15, at one end of the arm by a vertically adjustable screw 4, and at the opposite end thereof by an upwardly projecting portion of the roof 21 which is attached to the bracket by the bolt 18. The bracket further comprises an arm 8, perpendicular to the arm 6, and an arm 9, perpendicular to the arm 8 and parallel to the arm 6 but spaced from the arm 6. The arm 9 has attached substantially perpendicularly thereto an arm 10 which supports an arm 11, inclined to the arm 10 at a constant angle alpha ($\alpha$), defined by the axis of the arm 11 and by a line perpendicular to the axis of the arm 10, as shown in FIG. 3. The arm 11 supports roller 12 which is in contact with the inner tank wall 16.

The arm 6 has attached thereto a spring support element 7 having a cut-out 7A for supporting one end of the spring 20. The arm 9 has attached thereto a similar spring support element 7 with a cut-out 7A for supporting the opposite end of the spring 20. The top of the element 9 supports an auxiliary or secondary seal means 5 comprising a plurality of alternate spacing members 13, made e.g., of rubber or other elastic material, and lip members or fingers 5A, arranged as shown in the drawing on top of each other. (The construction of the secondary seal means is conventional in the art, e.g., see U.S. Pat. No. 4,099,643, the entire contents of which are incorporated herein by reference.) An element 17, e.g., an angle iron about 6 inches long and 2.0 inches wide, is welded to the arm 9. The element 17 supports an elongated seal support element 17A, e.g., an angle iron of about 3.0 inches width and 2 inches height, which connects consecutive brackets along the periphery of the roof. The element 17 is attached to the support element 17A by suitable fastening means, e.g., by bolts. In addition, a resilient and flexible skirt or secondary vapor barrier 23 is carried by the bracket elements 6 and 9. As shown in FIG. 3, the skirt is affixed to the arm 9 between the auxiliary sealing means and the element 17 to seal in the vapors. The skirt is affixed to the arm 6 in the lower portion of the bracket by the metal strip 2, shown in perspective in FIG. 2, and by a series of bolts 18 or by any other fastening means.

The arm 8 is attached to the arm 6 by means of a support element 3 and by a pivot element 14, such as a bolt shown in FIG. 3. The pivot element provides a convenient means for allowing the roller 12 to pivot with respect to the roof 15 as the roller moves vertically along the wall and encounters obstacles thereon. An adjustable sliding means 19 (shown in phantom lines in FIG. 3) permits movement of the entire bracket assembly towards or away from the tank wall 16, depending on the size of the tank and on the distance between the edge of the roof and the wall of the tank.

The adjustable sliding means 19 comprises a series of holes drilled in the arm 6 and in the support element 3, and a connecting means, such as a bolt shown in FIG. 3, for connecting the holes. The support element 3 is moved horizontally with respect to the arm 6 until its desired position with respect to the wall 16. The bolt, or other connecting means, is then inserted into the hole in the element 3 and into a corresponding hole in the arm 6, and fastened to lock into position the element 3 and the arm 6.

In operation, the spring 20, e.g., a compression spring, causes the wheel 12 to be pressed against the inner wall of the tank 16 during the vertical, upward or downward, movement of the roof 15 within the tank. When an obstacle on the inside wall of the tank is encountered, such as a rivet or a buttstrap, the wheel 12 is momentarily disengaged from contact with the tank wall. However, due to the force of the spring 20 and the construction of the auxiliary seal, the secondary seal elements 5A of the auxiliary seal cover the obstacle and the surrounding wall area to preserve the vapor seal. Thus, the vapors are effectively sealed in the vapor space defined by the primary seal, the secondary vapor barrier 23 and the secondary seal element 5A. As soon as the obstacle in the tank wall is passed, the wheel 12 and the auxiliary sealing elements 5A are urged back into full contact with the wall by the compression spring 20, as shown in FIG. 3. The spring-loaded wheel assures that the secondary seal is in constant contact with the wall despite irregularities in the wall and discrepancies in the diameter of the tank. When the roof and the bracket assembly travel upwardly, the secondary seal elements 5A are pressed against the wall and point downwardly as shown in FIG. 3. When the amount of stored liquid in the tank decreases and the roof begins to travel downwardly, the secondary seal elements 5A are pressed against the wall, but point in an upward direction.

The distance from the axis of the wheel 12 to the top of the auxiliary sealing element 5 is 3 inches to 6 inches, preferably 3.5 inches to 5.5 inches, and most preferably 4 inches to 5 inches. The spring used in the bracket has a sufficient compression force to continually urge the wheel 12 and the auxiliary sealing means 5 to press against the inner wall of the tank 16. It will be apparent to those skilled in the art that the size and compression force of the spring can be selectively chosen for a given tank, depending on the size of the tank, the size of the roof and the weight thereof, and on the number of bracket assemblies used for a particular installation.

The angle alpha is 10 to 60 degrees, preferably 20 degrees to 40 degrees, and most preferably 30 degrees. It will be apparent to those skilled in the art that a number of bracket assemblies 1 can be installed on the periphery of the floating roof tank 15 and that the exact number of the brackets can be easily selected by those skilled in the art depending on the structural details and performance requirements of a particular installation. It will also be apparent that the angle alpha may be substantially the same on all of the bracket assemblies, or it may be varied for any one or any number of the bracket assemblies, depending on the particular construction details of the floating roof and the tank.

In a typical installation for a riveted steel plate tank having a nominal capacity of 134,000 barrels, the auxiliary seal 5 of this invention is provided by spacers and wiper fingers of neoprene. The tank has a diameter of 144 feet, and it is 46 feet high. The wheel 12 has a diameter of 6 inches, the arm 11 supporting the wheel 12 is 11.25 inches long and 2 inches wide and the arm 10 is 10 inches long and 2 inches wide. The arm 9 and the arm 8 are both 2 inches wide; the arm 9 is 15 inches long; and, the arm 8 is 8 inches long. The spring 20 has a compression force of about 26 lbs./in. and it is made of zinc plated steel. The secondary vapor barrier 23 is made of cloth-reinforced neoprene about $\frac{1}{8}$ inch thick. The bracket assembly 1 comprising arms 8, 9, 10 and 11 is made of carbon steel. The wheel 12 is made of carbon steel covered with polyurethane. The angle alpha is 30 degrees. The roof 15 has the bracket assemblies 1 spaced every 15 feet around the circumference thereof. The distance from the top of the auxiliary sealing element 5 to the axle of the wheel 12 is about 4 inches.

From the foregoing specification, one skilled in the art can readily ascertain the essential features of this invention and without departing from the spirit and scope thereof can adopt it to various diverse applications.

What is claimed is:

1. In a floating roof tank having a vertical wall and containing a relatively volatile liquid, a buoyant roof floating on said relatively volatile liquid and extending to the vicinity of the interior of said vertical wall, a dependent sealing element extending downwardly from the periphery of the upper surface of said roof to engagement with said vertical wall, an auxiliary seal mounted on the periphery of the upper surface of said roof and spaced above said dependent sealing element, thereby defining a vapor space between said dependent sealing element and said auxiliary seal, a closure means connecting said upper surface of said roof with said auxiliary seal, thereby substantially preventing leakage from said vapor space, the improvement wherein said auxiliary seal is mounted on said roof by a spring-tensioned bracket means having attached thereto, but spaced above said auxiliary seal, a rolling means in contact with said wall, spring means of said spring-tensioned bracket means urging said rolling means and said auxiliary seal into contact with the interior of said vertical wall.

2. The floating roof tank of claim 1 wherein said spring-tensioned bracket means comprises a first bracket component attached vertically to said roof; a second bracket component attached perpendicularly to said first bracket component and spaced from said roof, said second bracket component supporting said auxiliary seal; said second bracket component comprising an elongated first member having two ends, a second member attached to said first member at a position intermediate said two ends, said second member having angularly attached thereto a third member, said third member supporting said rolling means at distal end thereof; and, a spring means having its first end attached to said roof and its second end attached to said first member of said second bracket component.

3. The floating roof tank of claim 2 wherein the first end of said closure means is attached to said periphery of said roof, and the second end thereof is attached to said second bracket component.

4. The floating roof tank of claim 3 wherein said auxiliary seal comprises a plurality of substantially horizontal layers of a relatively flexible material with spacing means interposed between the consecutive layers.

5. The floating roof tank of claim 4 wherein said third member is attached to said second member at an angle of 10 degrees to 60 degrees.

6. The floating roof tank of claim 1 wherein said buoyant roof has a plurality of said bracket means spaced along the periphery of said buoyant roof.

7. In a floating roof tank having a vertical wall and containing a relatively volatile liquid, a buoyant roof floating on said relatively volatile liquid and extending to the vicinity of the interior of said vertical wall, a dependent sealing element extending downwardly from the periphery of the upper surface of said roof to engagement with said vertical wall, an auxiliary seal mounted on the periphery of the upper surface of said roof and spaced above said dependent sealing element, thereby defining a vapor space between said dependent sealing element and said auxiliary seal, a closure means connecting said upper surface of said roof with said auxiliary seal, thereby substantially preventing leakage from said vapor space, the improvement wherein said auxiliary seal is mounted on said roof by a spring-tensioned bracket means having attached thereto, but spaced above said auxiliary seal, a rolling means in contact with said wall;

said spring-tensioned bracket means comprising a first bracket component attached vertically to said roof; a second bracket component attached perpendicularly to said first bracket component and spaced from said roof, said second bracket component supporting said auxiliary seal; said second bracket component comprising an elongated first member having two ends, a second member attached to said first member at a position intermediate said two ends, said second member having angularly attached thereto a third member, said third member supporting said rolling means at distal end thereof; and, a spring means having its first end attached to said roof and its second end attached to said first member of said second bracket component;

the first end of said closure means being attached to said periphery of said roof and the second end thereof being attached to said second bracket component;

said auxiliary seal comprising a plurality of substantially horizontal layers of a relatively flexible material with spacing means interposed between the consecutive layers.

8. The floating roof tank of claims 1, 5, 6 or 7 wherein at least one of said horizontal layers of a relatively flexible material of said auxiliary seal is horizontally slit from the edge thereof adjacent said vertical wall to form a plurality of radial fingers engaging said vertical wall.

9. The floating roof tank of claim 8 wherein said first bracket component is attached pivotally to said roof.

* * * * *